US005678370A

United States Patent [19]

Douglass

[11] Patent Number: 5,678,370

[45] Date of Patent: Oct. 21, 1997

[54] SURFACE COVERING

[75] Inventor: James E. Douglass, Earlsdon, United Kingdom

[73] Assignee: Stonemarket, Ryton-On-Dunsmore, Germany

[21] Appl. No.: 556,622

[22] Filed: Nov. 13, 1995

[30] Foreign Application Priority Data

Nov. 11, 1994 [GB] United Kingdom ..... 9422788
Dec. 23, 1994 [GB] United Kingdom ..... 9426137

[51] Int. Cl.[6] ..... E01C 5/00

[52] U.S. Cl. ..... 52/311.2; 404/37; 404/42

[58] Field of Search ..... 52/311.1, 311.2, 52/315, 390, 391, 392, 608, 609, 747.11, 747.12, 89, 102; 404/29, 34, 37, 38, 39, 40, 41, 42, 43, 46; 25/115, 118, 138, 140, 153, 156

[56] References Cited

U.S. PATENT DOCUMENTS 706,874 8/1902 Alcan ..... 52/315
1,474,779 11/1923 Zur Kammer ..... 52/311.2
4,376,596 3/1983 Green ..... 404/40
4,907,909 3/1990 Ruckstuhl ..... 404/38
5,067,295 11/1991 Francik et al. ..... 52/609
5,163,777 11/1992 Krueger et al. ..... 404/41

FOREIGN PATENT DOCUMENTS 1543965 9/1968 France ..... 404/41
487704 10/1930 Germany ..... 404/42

*Primary Examiner*—Michael Safavi
*Attorney, Agent, or Firm*—Foley & Lardner

[57] ABSTRACT

A surface covering formed by planar components includes a plurality of concentric rings with each ring formed by corner components having two pairs of parallel sides of different length. The shorter sides of the pairs of parallel sides meeting at an angle equal to an angle formed by adjacent sides of a regular polygon. While the longer sides of the pairs of parallel sides meet at an angle equal to an angle formed by adjacent sides of the regular polygon. Planar infill components are utilized between the corner components with adjacent polygonal rings varying in size by a whole number of infill components. Spacing elements may be disposed between adjacent concentric polygonal rings.

26 Claims, 4 Drawing Sheets

Fig. 1
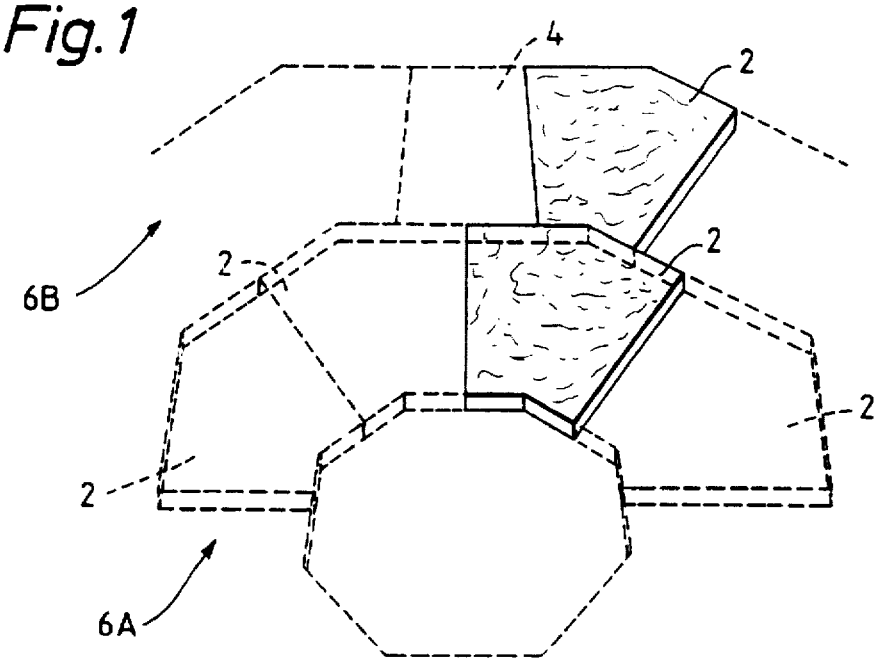
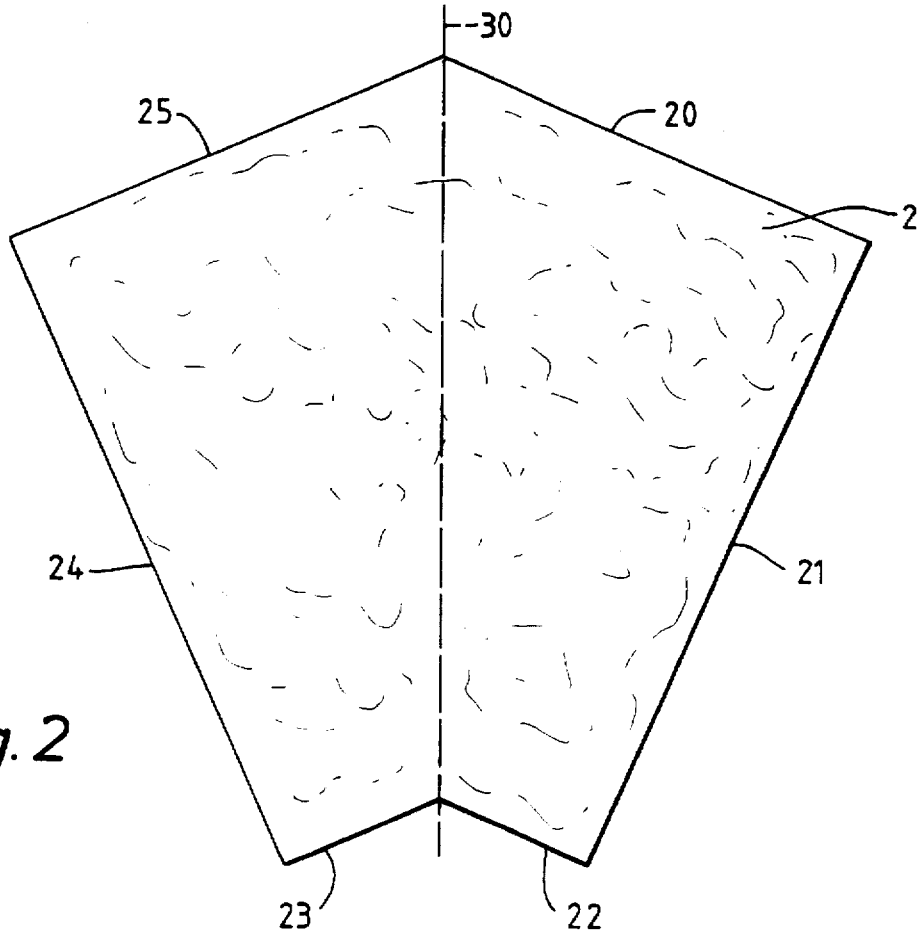
Fig. 2

SURFACE COVERING

This invention relates to a surface covering and in particular, to a surface covering which may be constructed from a plurality of covering components.

For many centuries, surfaces have been covered using a plurality of covering components such as bricks, stone slabs and much more recently, precast concrete slabs. In order to arrange the components in varied and aesthetically pleasing patterns, it is frequently necessary to provide a large variety of different components, to cut the components on-site and/or to transport awkwardly-shaped components.

It is an object of the present invention to provide a surface covering which requires relatively few components and which components are easily transportable.

According to the invention there is provided a surface covering for covering a surface with concentric rings or portions thereof of covering components defining a polygon, the covering comprising at least one corner component having two pairs of parallel sides, the sides of each pair being of different lengths, and one pair forming with the other pair an angle which is substantially equal to the angle formed between two adjacent sides of the regular polygon.

Preferably the corner components are planar.

Preferably the polygon is a regular polygon, although opposing sides of the polygon may be adjusted to equal amounts to give an irregular shape.

Preferably, the surface covering also comprises a planar infill component, having sides which correspond in length and angle to the non-parallel sides of the corner component.

In use, a concentric regular polygonal ring is preferably constructed using only a plurality of corner components or only a plurality of corner components and infill components. Furthermore, the two pairs of sides of the corner component preferably meet on a radius of the ring.

Preferably, the corner component has six sides and the remaining two non-parallel sides of the corner component are preferably arranged to meet each respective pair of parallel sides at an angle of 90°. This construction permits an infill component having four sides each adjacent side forming an angle of 90°, to be used with the corner component. Having chosen the internal radius (A) to the mid point of the sides on an innermost regular polygonal ring composed solely of corner components and the thickness (B) of the ring i.e. the length of the two non-parallel sides of the corner component, the other dimensions of the corner and infill components may be calculated as follows:

| | |
|---|---|
| Length of shorter side of each pair of parallel sides | $A \cdot \tan\theta$ |
| Length of longer side of each pair of parallel sides | $(A + B) \cdot \tan\theta$ |

for innermost ring (i.e one only comprising corner components) whereas the dimensions of the infill component are:

| | |
|---|---|
| Thickness of the infill component | B (chosen above) |
| Length of other pair of sides of infill component | $2B \cdot \tan\theta$ |

Where $\theta$ is 360°/2n, where n is the number of sides of the regular polygon.

Advantageously, the corner component may be subdivided into two, three or more pieces.

In a preferred embodiment, the two pairs of parallel sides of the corner component may meet on a line which bisects the corner component.

Advantageously, only standard sizes of corner components and infill components are required to produce a covering having any desired number of concentric rings. In order to achieve this, the distance between the corner components of each successive ring should vary from the distance of the preceding ring by an integer number of infill elements. In order to achieve this, the dimensions of the corner components are chosen such that the length of the long side of the corner component is equal to the sum of the length of the short side of the corner component and half the length of the infill component.

Thus in an embodiment for making hexagonal rings, the dimensions of the infill component having unit width is 1 by 1.155, whereas the short sides of the corner component have a length 0.289 units and the long sides are 0.866 units.

These can, of course, be reduced to a purposely leave a gap between adjacent elements for decorative affect or for the inclusion of a fixing material such as cement.

In a further preferred embodiment, the two comers formed between the two pairs of parallel sides of the corner component is radiussed and in this context, it will be understood that the angles formed between the two pairs of lines is the angle formed between an extension of each of the lines.

The invention will now be described by way of example with reference to the drawings FIGS. 1 to 6 in which:

FIG. 1 is a perspective view of a surface covering in accordance with the invention;

FIG. 2 is an enlarged view of a corner component of FIG. 1;

Figure 3:
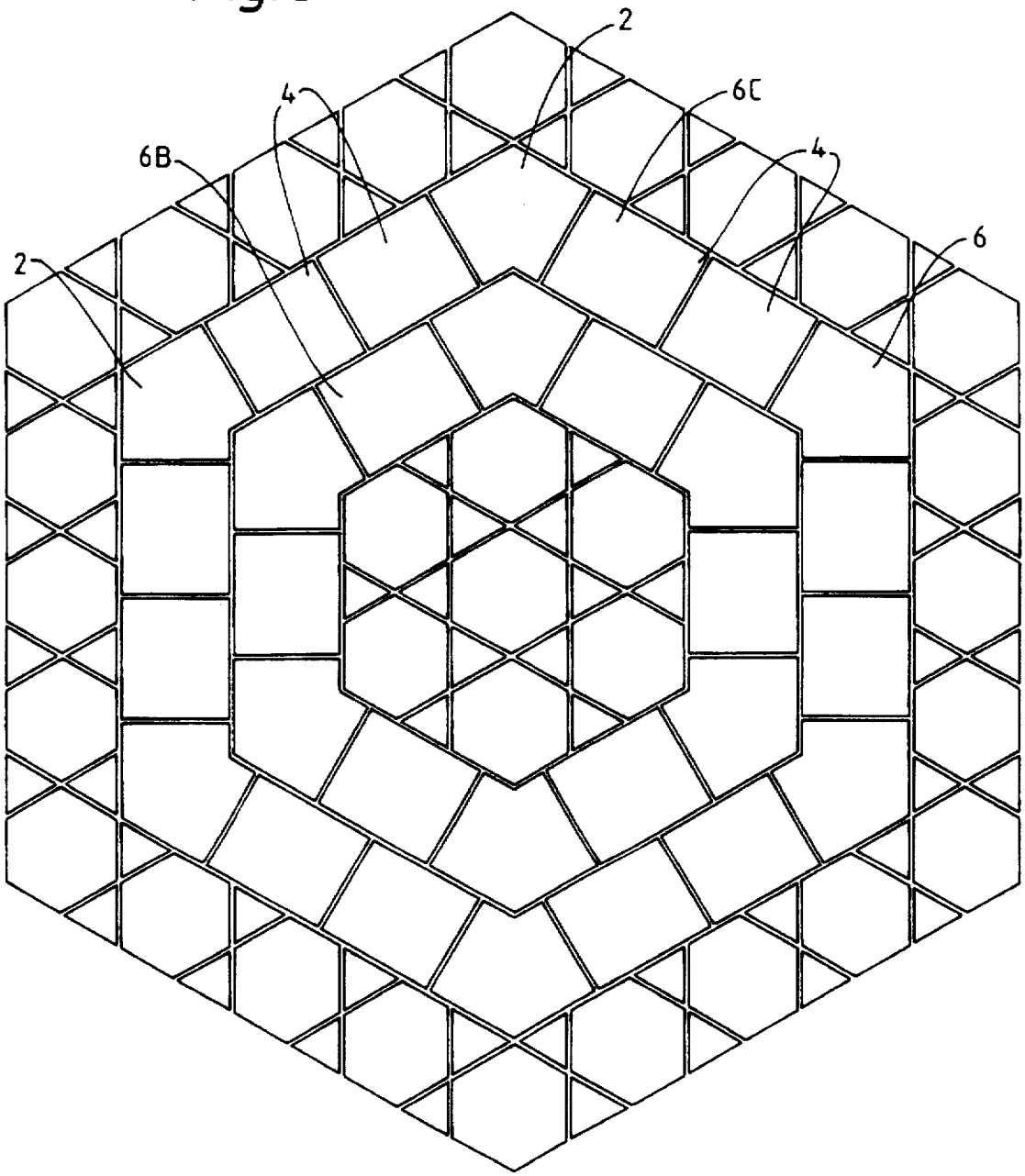
FIG. 3 is a plan view of a surface covering in accordance with the invention.

With reference to FIGS. 1 and 2, the surface covering comprises a plurality of corner components 2 and infill components (in this embodiment rectangles) 4. The components together form a series of concentric octagonal rings (generally indicated 6A, 6B etc.). As will be seen from FIG. 1, the inner ring 6A is constructed entirely from corner components. As the rings increase in size, the gaps between each corner 2 component are filled with the infill components 4. For example, in ring 6B, one infill component is required between each corner component. In the next ring (6C as shown in FIG. 3) two infill components are required between each corner piece and so on. The corner component is shown in greater detail in FIG. 2. It is shaped so as to have six sides 20 to 25. A first side 20 is parallel with a third side 22. A second side 21 extends between the first and third sides and is perpendicular to both of them. The third side 22 is shorter than the first side 20. The first and third sides intersect with the fourth and sixth sides 23 and 25 (which are parallel to each other) at a plane of mirror symmetry denoted by the chain line 30. Thus the fourth, fifth and sixth sides effectively mirror the first, second and third sides.

The angles between the first and sixth sides and between the third and fourth sides vary depending on the number of sides of the polygon.

With reference to FIG. 3, it will be seen that the rings 6, may in order to increase the variety of the pattern, be interspersed with components of different shapes which form rings in substitution for one or more rings 6.

Figure 4:
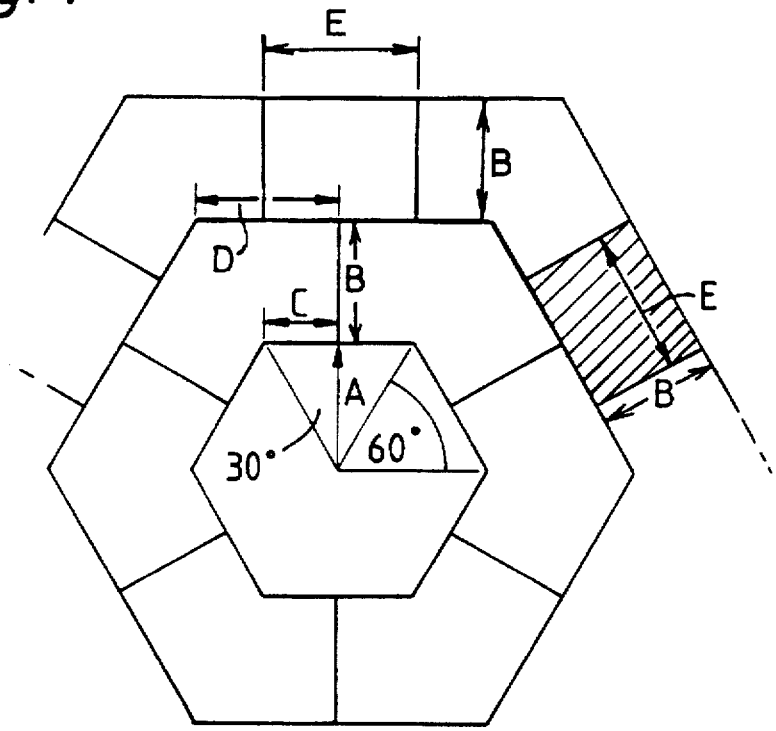
FIG. 4 is a plan view of a hexagonal embodiment in accordance with the invention.
Figure 5:
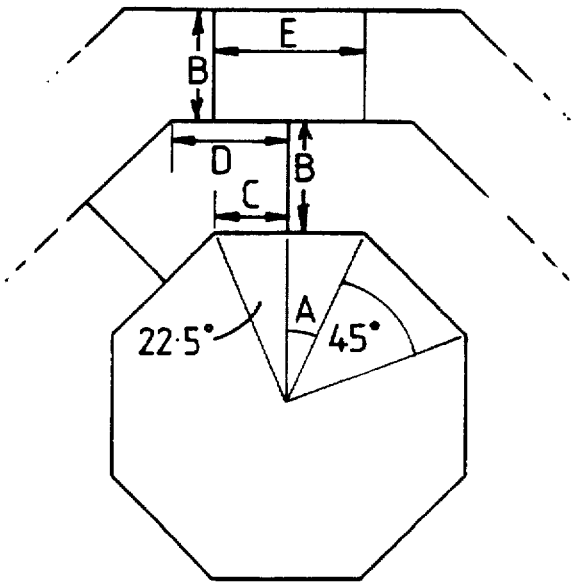
FIG. 5 is a plan view of an octagonal embodiment in accordance with the invention.

With reference to FIGS. 4 and 5, it will be seen that the invention is applicable not only to hexagonal but to other arrangements such as octagonal arrangements.

Figure 6:
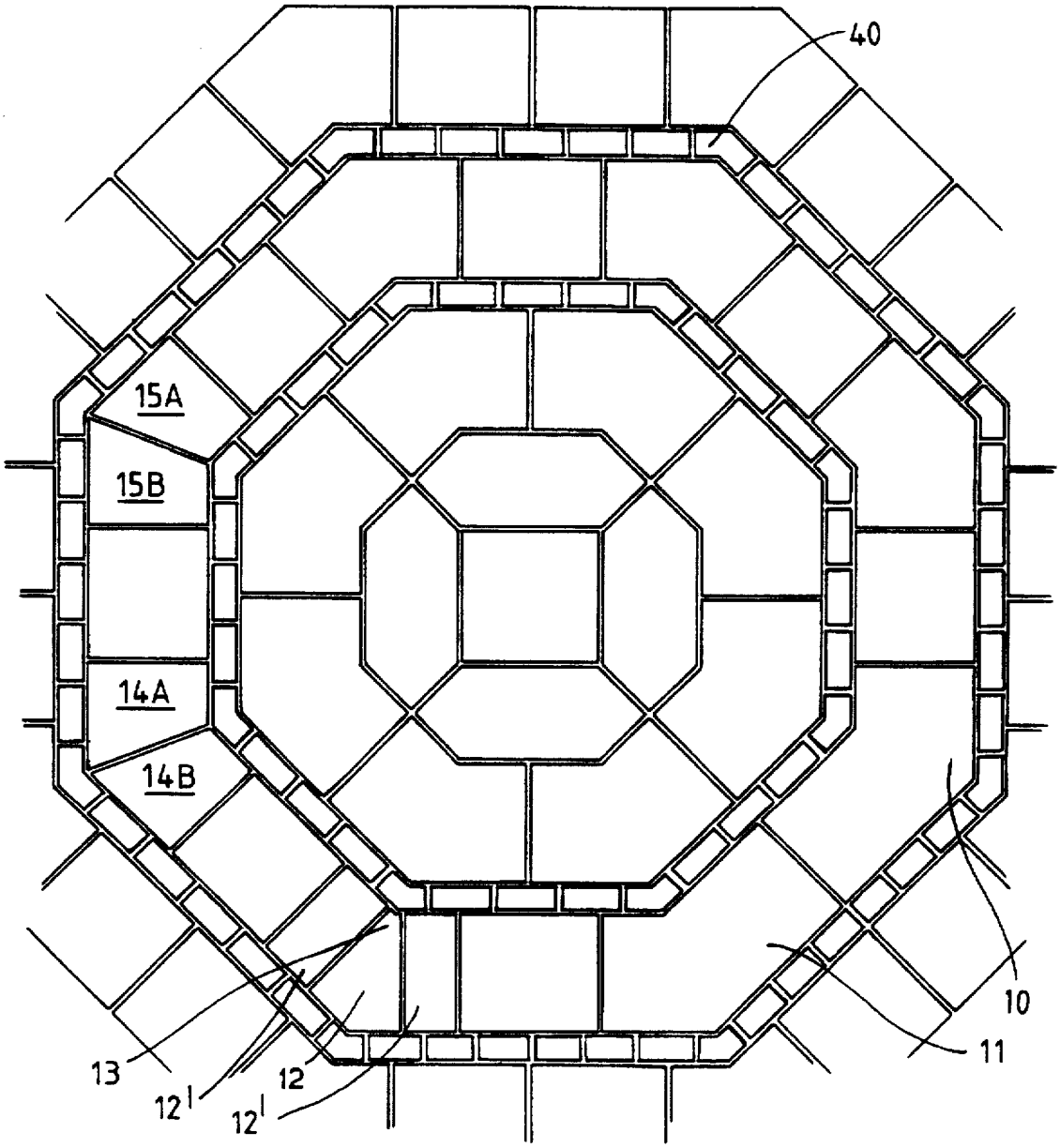
FIG. 6 is a plan view of a further octagonal embodiment of the invention.

With reference to FIG. 6, it will be seen that a corner component 2 can be combined with an infill component to form a unitary corner/infill component 10, 11. Alternatively, the corner component can be reduced in size as shown for component 12 which can be regarded as the central section of a corner component provided as three individual pieces 12 and 12'. The thin end 13 of the component 12 may taper to a point or may be notched to accommodate an outer surface of a component in the next innermost ring. A further variation on the corner component is to provide a corner component in two halves e.g. component 14A,14B and 15A,15B respectively.

FIG. 4 shows a plan view of the hexagonal arrangement of FIG. 1. Having chosen values for dimensions A and B marked on the drawings, the other dimensions may be calculated as follows:

| | |
|---|---|
| Central Hexagon | |
| Length of one side of the centre hexagon | 2A · tan 30° |
| Corner Component | |
| Dimension C | A · tan 30° |
| Dimension D | (A + B) · tan 30° |
| Infill Component | |
| Dimension E | 2B · tan 30° |

Similarly, the dimensions of FIG. 5 may be calculated (having chosen values for dimension A and B) with the substitution throughout of 22.5° for 30°. Generally, the angle may be substituted with θ where θ is 360°/2n where n is the number of sides of the shape of the rings or of the central clear area (pentagon, hexagon, octagon etc.).

As shown in FIG. 6, the dimensions of the surface coverings may be altered so as to allow for the inclusion of smaller decorative spacing element, 40. These also have the advantage that the dimensions of the elements 40 can be chosen such that the infill components 4 are square.

It can be seen in FIG. 3 that the innermost hexagon has one infill component between adjacent corner components, whereas the next row has two infill components between adjacent corner components. This increase could be carried on indefinitely.

In general, the outermost edge of an Nth row must be substantially equal in length to the innermost edge of the (N+1)th row.

If the short sides of the corner components have length C, the long sides have length D, and the length of the infill component is L, then $$2D+NL=2C+(N+1)L$$

thus D=C+L/2. This can be satisfied if C=½B tanθ and D=3/2B tanθ when L=2B tanθ.

It is also apparent from FIG. 3 that any of the concentric rings can be replaced by a plurality of hexagonal and triangular elements. The covering shown in FIG. 3 can therefore be regarded as four concentric rings surrounding a central hexagonal stone. The first and fourth rings (i.e innermost and outermost) are formed from combinations of hexagonal and triangular elements, whereas the second and third rings are formed on corner elements and infill pieces.

In a first example of hexagonal paving, the dimensions are A=150 mm, B=300 mm, C=87 mm, D=260 mm and E=346 mm.

In a first example of octagonal paving A=367.5 mm, B=735 mm, C=152 m, D=456 mm and E=609 mm.

In a second example of octagonal paving A=181 mm, B=543 mm, C=75 mm, D=300 mm and E=450 mm.

I claim:

1. A surface covering including a plurality of concentric polygonal rings the surface covering comprising:

a plurality of planar corner components, each corner component including two pairs of parallel sides, each pair of parallel sides having a longer side and a shorter side, the shorter sides meeting at an angle substantially equal to an angle formed by adjacent sides of a regular polygon, the longer sides meeting at an angle equal to the angle formed by adjacent sides of the regular polygon; and a plurality of planar infill components disposed between the corner components, wherein each polygonal ring includes corner components of the same size, and adjacent polygonal rings vary by an integer number of infill components.

2. The surface covering as recited in claim 1, wherein the infill components are rectangular.

3. The surface covering as recited in claim 1, wherein each corner component further comprises a pair of non-parallel sides, each non-parallel side extending between the longer and shorter sides of a respective pair of parallel sides, and each planar infill component having a pair of first sides corresponding substantially to the length of the non-parallel sides.

4. The surface covering as recited in claim 3, wherein each non-parallel side is substantially perpendicular to its respective pair of parallel sides.

5. The surface covering as recited in claim 1, wherein an innermost polygonal ring of the plurality of concentric polygonal rings consists solely of corner components, the innermost polygonal ring having an internal radius A and a width B equal to a distance between the longer and shorter sides, the dimensions of the corner components being calculated as follows:

Length of shorter side=A tanθ

Length of longer side=(A+B) tanθ where θ=360°/2n and n is the number of sides of the innermost polygonal ring.

6. The surface covering as recited in claim 5, wherein the infill components are rectangular and have pairs of first and second sides, the dimensions of the infill components being calculated as follows:

Length of first side=B

Length of second side=2B tanθ.

7. The surface covering as recited in claim 1, wherein the pairs of parallel sides of the corner component intersect at a line which bisects the corner component.

8. The surface covering as recited in claim 7, wherein at least one corner component is divided at the line into two separate pieces.

9. The surface covering as recited in claim 1, wherein at least one corner component is formed by a pair of outer rectangular pieces and an inner piece, the inner piece being substantially wedge-shaped and disposed between the outer rectangular pieces.

10. The surface covering as claimed in claim 1, further comprising a plurality of spacing elements disposed between adjacent concentric polygonal rings.

11. The surface covering as recited in claim 1, wherein at least one polygonal ring is composed of a plurality of hexagonal and triangular elements.

12. The surface covering as recited in claim 1, wherein the polygonal rings are hexagonal.

13. The surface covering as recited in claim 1, wherein the polygonal rings are octagonal.

14. A surface covering including a plurality of concentric portions of a plurality of polygonal rings, the surface covering comprising:

a plurality of planar corner components, each corner component including two pairs of parallel sides, each pair of parallel sides having a longer side and a shorter side, the shorter sides meeting at an angle substantially equal to an angle formed by adjacent sides of a regular polygon, the longer sides meeting at an angle equal to the angle formed by adjacent sides of the regular polygon; and a plurality of planar infill components disposed between the corner components, wherein each concentric portion of each polygonal ring includes corner components of the same size, and adjacent concentric portions vary by an integer number of infill components.

15. The surface covering as recited in claim 14, wherein the infill components are rectangular.

16. The surface covering as recited in claim 14, wherein each corner component further comprises a pair of non-parallel sides, each non-parallel side extending between the longer and shorter sides of a respective pair of parallel sides, and each planar infill component having a pair of first sides corresponding substantially to the length of the non-parallel sides.

17. The surface covering as recited in claim 16, wherein each non-parallel side is substantially perpendicular to its respective pair of parallel sides.

18. The surface covering as recited in claim 14, wherein an innermost portion of the plurality of concentric portions consists solely of corner components, the innermost portion having an internal radius A and a width B equal to a distance between the larger and shorter sides, the dimensions of the corner components being calculated as follows:

Length of shorter side=A tanθ

Length of longer side=(A+B) tanθ where θ=360°/2n and n is the number of sides of a polygon of which the innermost portion of the plurality of concentric portions forms part.

19. The surface covering as recited in claim 18, wherein the infill .components are rectangular and have a pair of first and second sides, the dimensions of the infill components being calculated as follows:

Length of first side=B

Length of second side=2B tanθ.

20. The surface covering as recited in claim 14, wherein the pairs of parallel sides of the corner component intersect at a line bisecting the corner component.

21. The surface covering as recited in claim 20, wherein at least one corner component is divided at the line into two separate pieces.

22. The surface covering as recited in claim 14, wherein at least one corner component is formed by a pair of outer rectangular pieces and an inner piece, the inner piece being substantially wedge-shaped and disposed between the outer rectangular pieces.

23. The surface covering as recited in claim 14, further comprising a plurality of spacing elements disposed between adjacent concentric portions of the polygonal ring.

24. The surface covering as recited in claim 14, wherein at least one concentric portion of the polygonal ring is composed of a plurality of hexagonal and triangular elements.

25. The surface covering as recited in claim 14, wherein the plurality of concentric portions of the polygonal ring are part of a hexagon.

26. The surface covering as recited in claim 14, wherein the plurality of concentric portions of the polygonal ring are part of an octagon.

* * * * *

UNITED STATES PATENT AND TRADEMARK OFFICE

CERTIFICATE OF CORRECTION

PATENT NO. : 5,678,370

DATED : October 21, 1997

INVENTOR(S) : James E. Douglass

It is certified that error appears in the above-indentified patent and that said Letters Patent is hereby corrected as shown below:

On the title page, item [73] should read:

[73] Assignee: Stonemarket, Ryton-On-Dunsmore, United Kingdom

Signed and Sealed this

Twentieth Day of January, 1998

*Attest:*

*Attesting Officer*

BRUCE LEHMAN

*Commissioner of Patents and Trademarks*